United States Patent [19]

Rushing

[11] Patent Number: 4,981,224

[45] Date of Patent: Jan. 1, 1991

[54] STACKING TRAY DISPLAY

[75] Inventor: Tom Rushing, Denville, N.J.

[73] Assignee: The Howard Marlboro Marketing, Inc., New York, N.Y.

[21] Appl. No.: 437,443

[22] Filed: Nov. 15, 1989

[51] Int. Cl.[5] ..... A47F 3/14

[52] U.S. Cl. ..... 211/126; 211/194

[58] Field of Search ..... 211/126, 188, 194, 186, 211/128; 312/106, 144, 114

[56] References Cited

U.S. PATENT DOCUMENTS 4,503,781 3/1985 Nilsson ..... 108/114 X 4,550,838 11/1985 Nathan et al. ..... 211/128

4,582,001 4/1986 Leikarts ..... 108/144 X 4,901,872 2/1990 Lang ..... 211/194 X 4,930,643 6/1990 Flum ..... 211/194 X

*Primary Examiner*—Blair M. Johnson

*Attorney, Agent, or Firm*—Darby & Darby

[57] ABSTRACT

A modular stacking display including trays and support posts extending between the trays so as to space one tray above the other. The support posts each have an H-shaped cross-section which are friction fit into T-shaped slots in the trays so as to thereby interlock the trays. When two modular stacking display units are arranged side-by-side, at least one support post is commonly shared therebetween and sidewalls of adjacent trays are flush against each other.

8 Claims, 7 Drawing Sheets

STACKING TRAY DISPLAY

BACKGROUND OF THE INVENTION

The present invention relates to stacking tray displays. Stores rent out shelf space by predetermined size allotments, e.g., by dividing up available shelf space by uniform amounts. This space allotment is strictly adhered to; otherwise the store will lose rental income. For instance, if everyone who rented exceeded their allotment by even a half inch, the combined total extra space used for such excess would mean that at least one space allotment would be much smaller than all the rest.

Even where someone rents out an entire shelf, it is wasteful to take up space that does not contain merchandise. Conventionally, doubling or tripling the amount of merchandise which can be displayed on a given allotment of shelf space has been effected by stacking trays one over the other. However, side-by-side stacking tray display units use up excess space when each have their own stacking posts which project outward therebetween, i.e., a distance equal to the amount of two support posts exists between side-by-side trays. Further, the stability of each stacking tray display unit is dependent on its own individual ability to support its trays, because each unit stands alone. Thus, individual stacking tray displays may be subject to becoming wobbly due to excess weight or improper alignment of the support posts which interconnect a pair of trays one over the other.

It would therefore be desirable to provide a stacking tray arrangement which enables side-by-side trays to be flush against each other so as to thereby minimize the amount of shelf space required. It would also be desirable to minimize the number of support posts required and yet increase stability over that for stand alone stacking tray display units.

SUMMARY OF THE INVENTION

The present invention is directed to a modular stacking display having a plurality of horizontally sloping trays each with vertical sidewalls which present generally flat outer surfaces. The display also has a plurality of elongated support posts of H-shaped cross-section which interconnect the trays in a releasably locking manner both one over the other and side-by-side simultaneously. This interconnection is effected by providing a corresponding T-shaped slot within the confines of each adjacent vertical sidewall such that two of such T-shaped slots together form an H-shaped slot which can accommodate the H-shaped support post therein.

Preferably, each T-shaped slot is divided between an upper and a lower vertical slot section separated by a horizontal wall portion of the tray. Each vertical sidewall would then have two pairs of upper and lower vertical slots.

The H-shaped support posts preferably are friction fit into the T-shaped grooves. Thus, they have a tendency to remain in the grooves rather than fall out due to gravity.

For a better understanding of the present invention, reference is made to the following description and accompanying drawings while the scope of the invention is set forth in the appended claims.

BRIEF DESCRIPTION OF THE DRAWINGS

FIG. 3 shows a perspective view of the stacking tray unit of

DESCRIPTION OF THE PREFERRED EMBODIMENT

Figure 1:
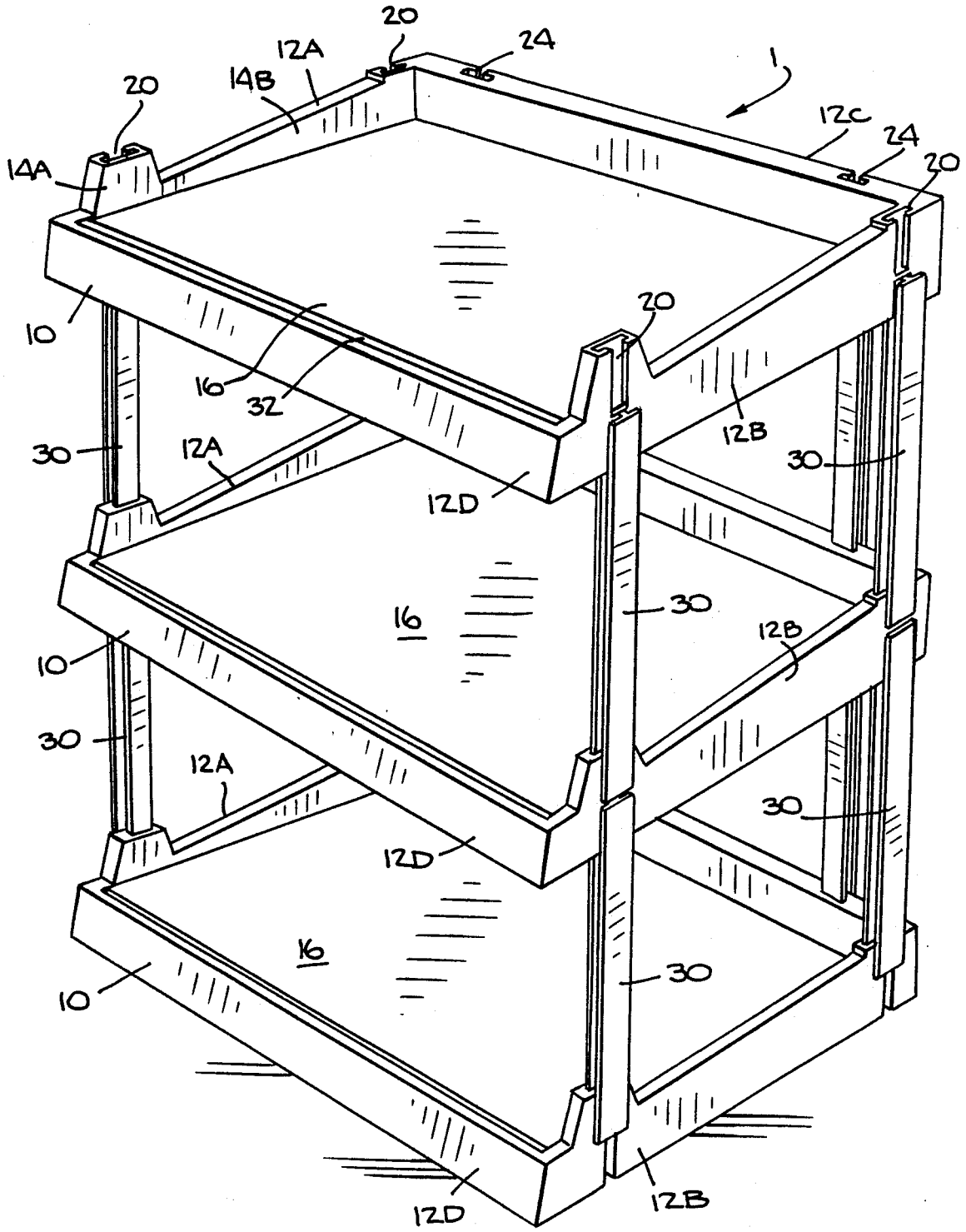
FIG. 1 shows a perspective view of a stacking tray unit with three tiers or levels of display trays in accordance with the present invention.
Figure 2:
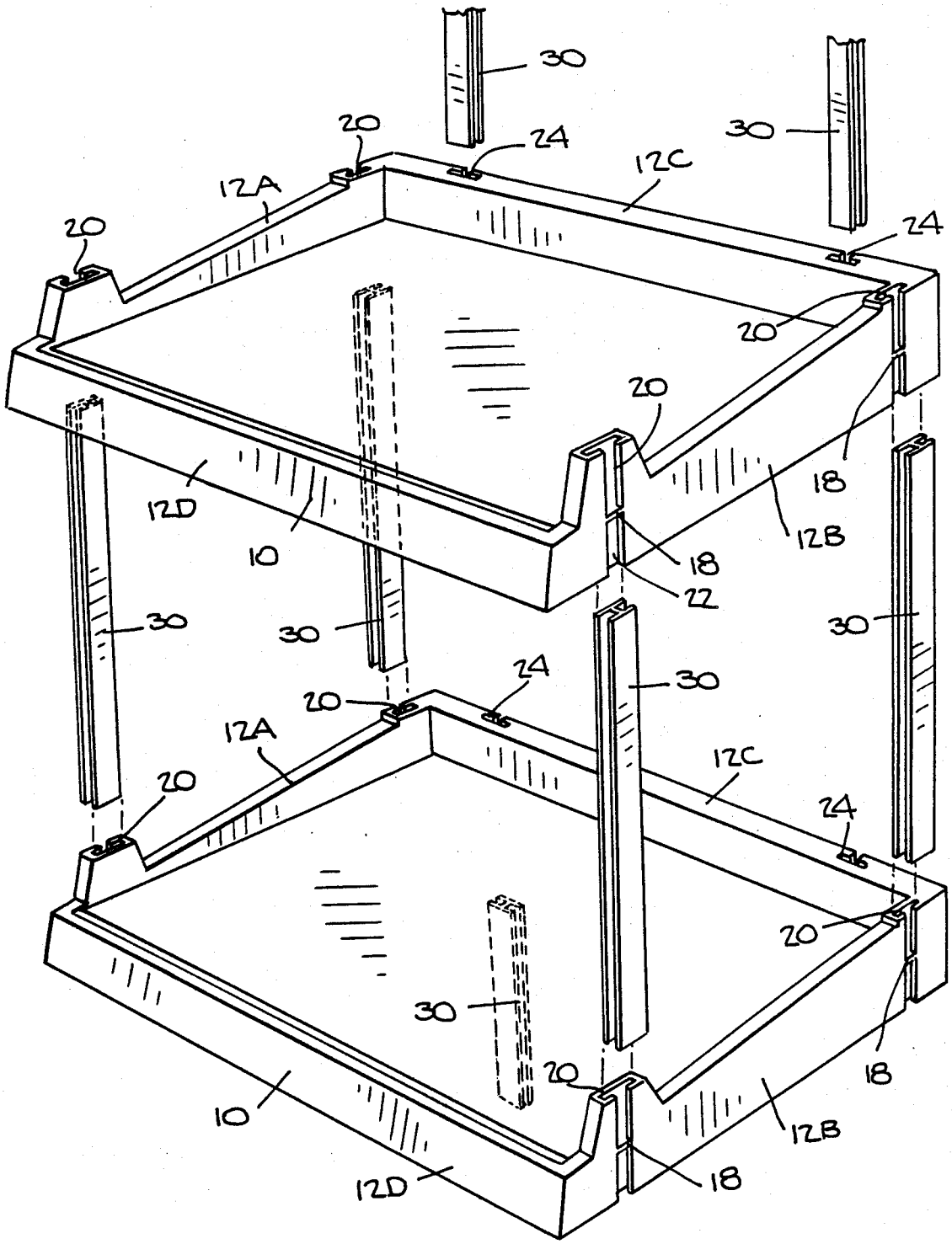
FIG. 2 shows an exploded perspective view for two of the three tiers or levels of display trays of FIG. 1.

Turning to the drawings, FIG. 1 shows a modular stacking display unit 1 which has three horizontally sloping trays 10 stacked in alignment one over the other and spaced apart from each other vertically. A plurality of elongated support posts 30 extend between each level or tier of trays. Preferably, there are four posts interconnecting the trays vertically. Each support post 30 has an H-shaped cross-section.

Each tray 10 is comprised of a base 16 and sidewalls 12A, 12B, 12C. Each sidewall extends perpendicularly from the periphery of the base 16. Sidewalls 12A. 12B face opposite each other and are parallel to each other; sidewall 12C extends perpendicular to sidewalls 12A, 12B.

Sidewalls 12A, 12B include three portions a lower rectangular-shaped portion, an upper trapezoidal-shaped portion 14A, and an upper right triangular-shaped portion 14B. The two upper portions are side-by-side and are above the lower portion, which is closer to the base than either of the upper portions. The right triangular-shaped portion has its right angle adjacent to the lower portion and to sidewall 12C. The incline formed by the right triangular-shaped portion, i.e., the hypotenuse, can be considered to be continuing at the same angle of decline at the opposite side of the trapezoidal-shaped portion 14B further from the sidewall 12C. If desired, the front of the base may slope downward at a steeper angle than the incline of the right triangular-shaped portion for the entire height of the lower portion so as to form a sloping wall 12D.

Each upper portion 14A, 14B has a respective T-shaped slot 20 which extends vertically within the confines of the respective upper portion. The lower portion has two T-shaped slots 22 in alignment respectively with slots 20. The aligned T-shaped slots 20 and 22 in sidewalls 12A, 12B are separated from each other by a stopping wall portion 18.

Sidewall 12C has a generally rectangular shape with its own T-shaped slots 24, which are identical to T-shaped slots 20, 22 except that no comparable stopping wall portion 18 need be provided. Thus, slots 24 are each continuous along the entire height of sidewall 12C. Of course, a comparable stopping wall portion may be employed to divide each of the slots 24 in a manner similar to that for T-shaped slots 20, 22.

H-shaped support posts 30 are friction fit into each of the T-shaped slots 20, 22, 24. They can be inserted into slots 20, 22 only as far as stopping wall 18 will allow. Since slot 24 has no stopping wall, an H-shaped support post can be inserted through the entire slot; therefore, a support post which is as high as the height of the entire stacking display unit could be provided to give added strength to the unit insofar as such a support post is continuous and spans the length of three or more tiers or levels of trays, rather than just two tiers or levels.

Figure 3:
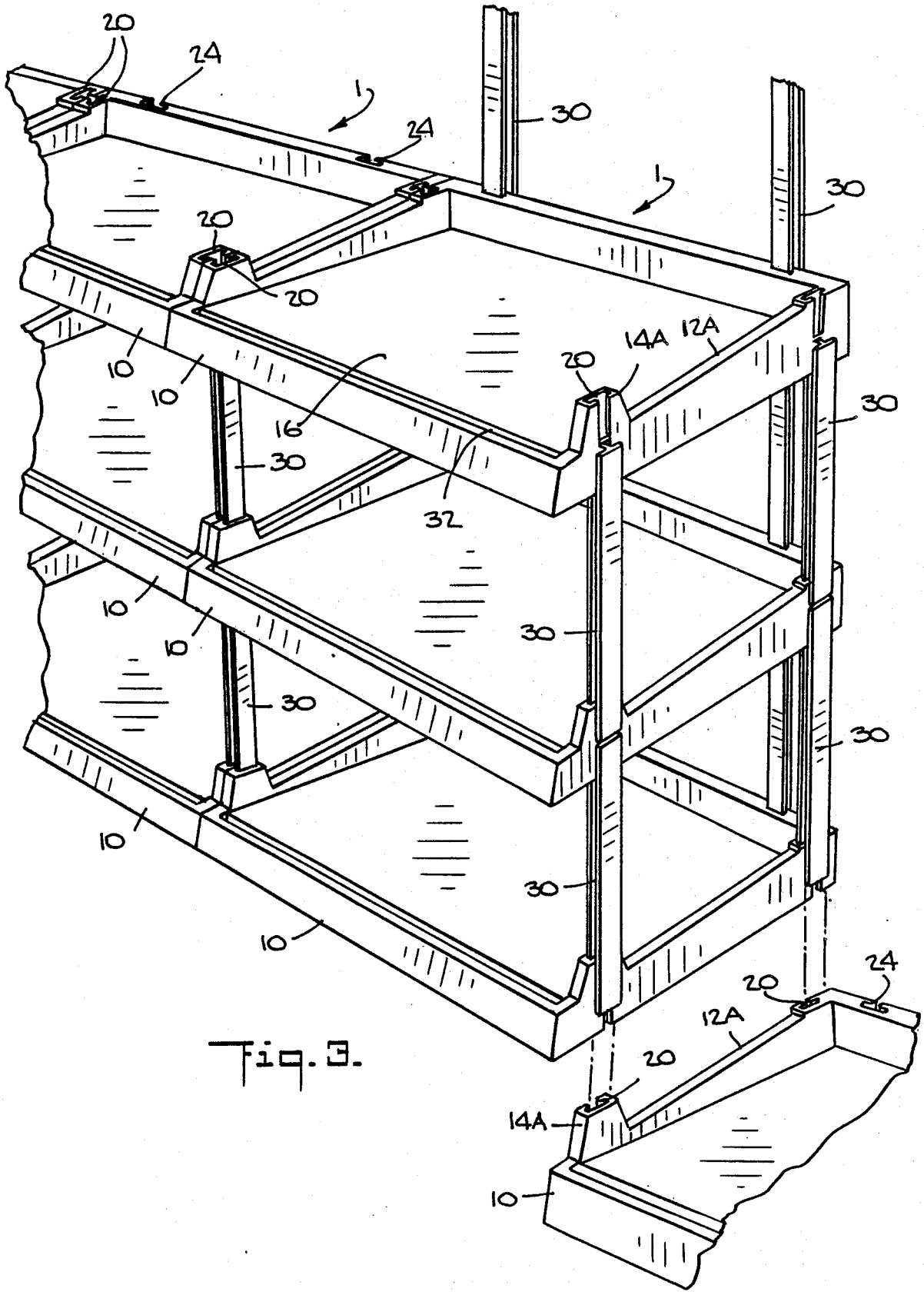
Figure 4:
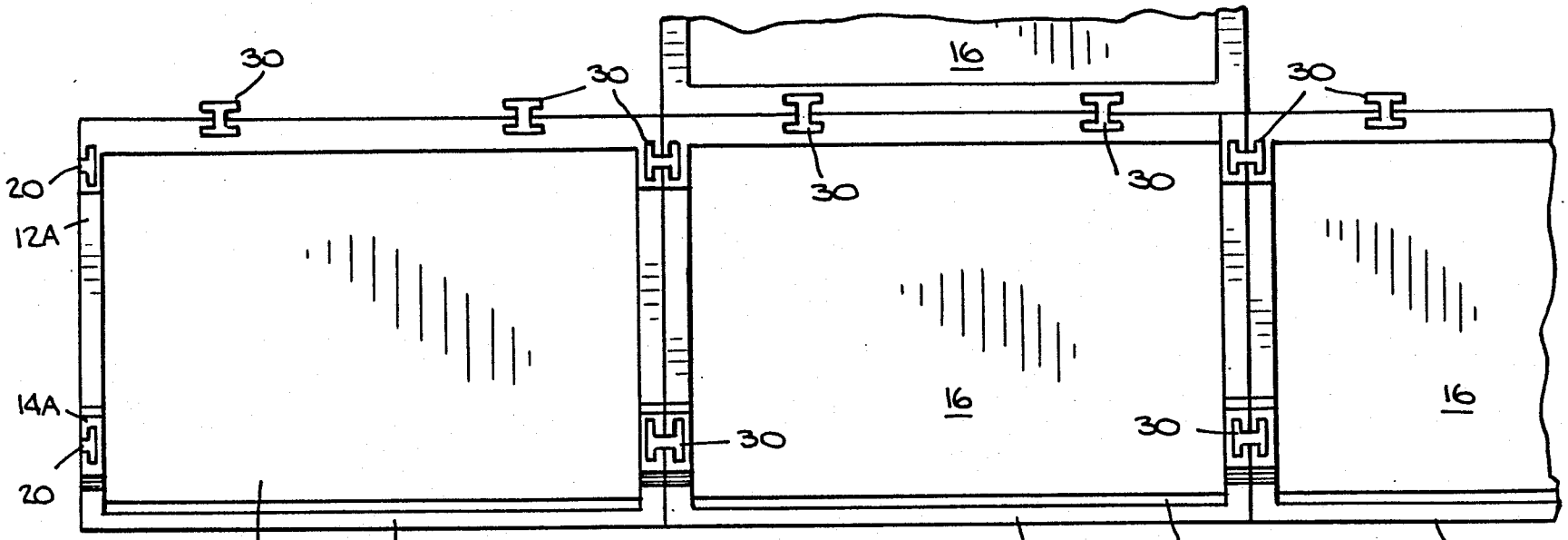
FIG. 4 shows a top view of FIG. 3, but further includes a partial view of an additional display tray in place.

FIGS. 3 and 4 show identical stacking display units 1 interlocked side-by-side such that adjacent sidewalls of the support trays are flush against each other. The H-shaped support posts are shared by the adjacent stacking display units. This is due to the adjacent T-shaped grooves from adjacent sidewalls together forming an H-shaped groove, into which is accommodated the H-shaped support post in an interlocking manner.

The use of such common support posts to interlock not only vertically spaced apart trays of a respective modular stacking display unit but also to interlock adjacent stacking display units provides advantages in providing greater stability, reducing the number of support posts required and enabling a sidewall of at least the bottom trays of adjacent stacking display units to be flush against each other. Each of these advantages are not realized by stand alone conventional stacking display units that are arranged independent of each other.

Greater stability is realized for the entire stacking display unit assembly because weight of the entire assembly is distributed throughout the assembly where common support posts are employed. Thus, there is less of a likelihood that any support post will become wobbly due to destabilizing forces that may otherwise arise from the weight.

The complimentary shape of the H-shaped support post friction fit for interlocking into the H-shaped groove (which is formed by two T-shaped grooves of adjacent sidewalls of adjacent trays) are arranged to enable the adjacent sidewalls of the adjacent trays to be flush against each other. These adjacent sidewalls have complimentary outer surfaces to ensure they are flush against each other.

As an added feature, a slot or groove 32 extends the entire length of the base 16 between sidewalls 12A, 12B so as to be parallel to sidewall 12C. The slot or groove 32 is preferably spaced further from sidewall 12C than is the trapezoidal-shaped portions 14A. The slot or groove 32 is used for holding an advertisement sign. A bottom portion of the sign is inserted into the slot or groove 32 and the remainder extends out of the slot or groove 32 and is visible to an observer. Projections 34 interposed on opposite facing walls of the groove 32 in an alternating manner hold the sign therebetween into position.

Figure 5:
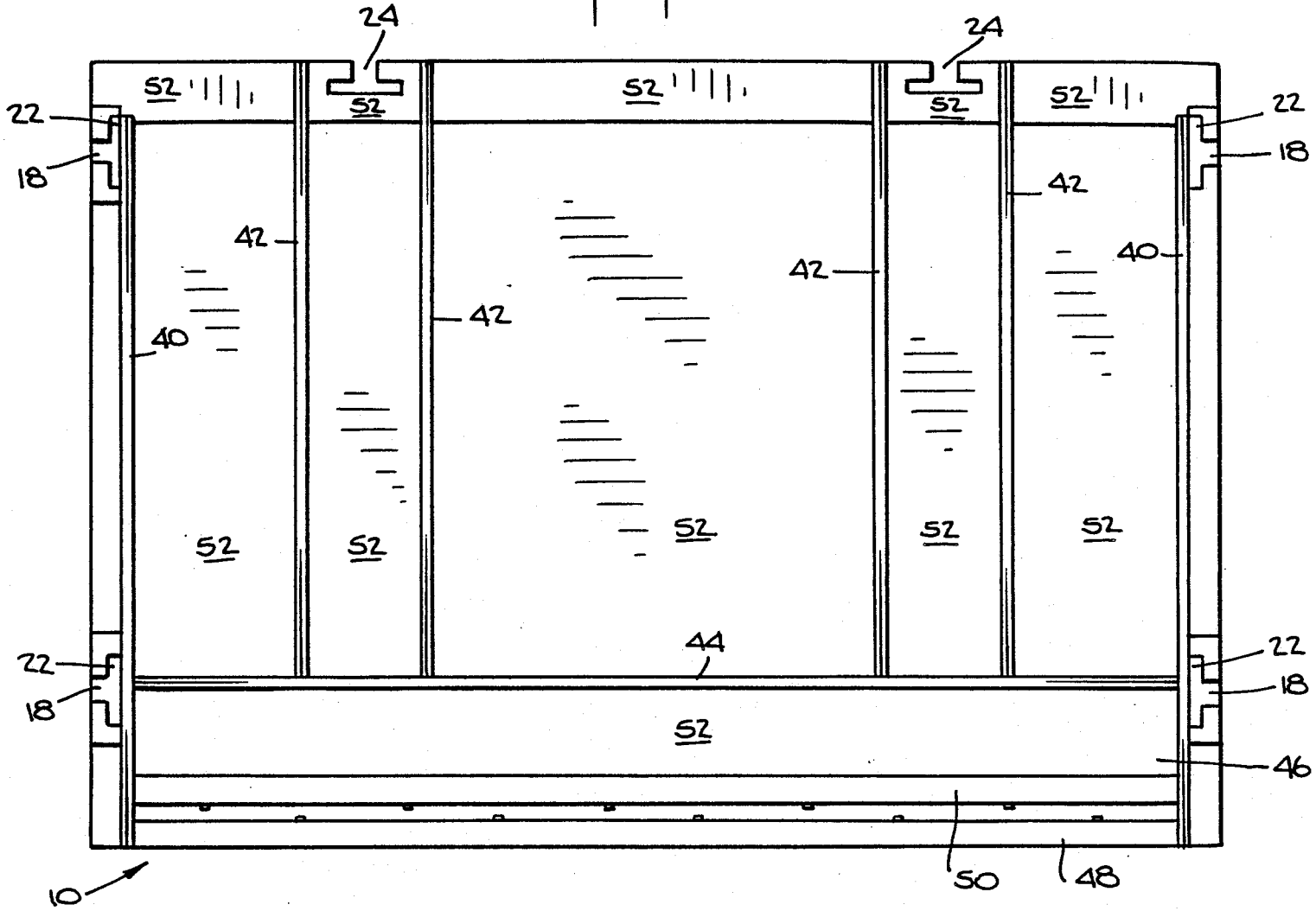
FIG. 5 shows a bottom view of a tray of FIG. 1.
Figure 6:
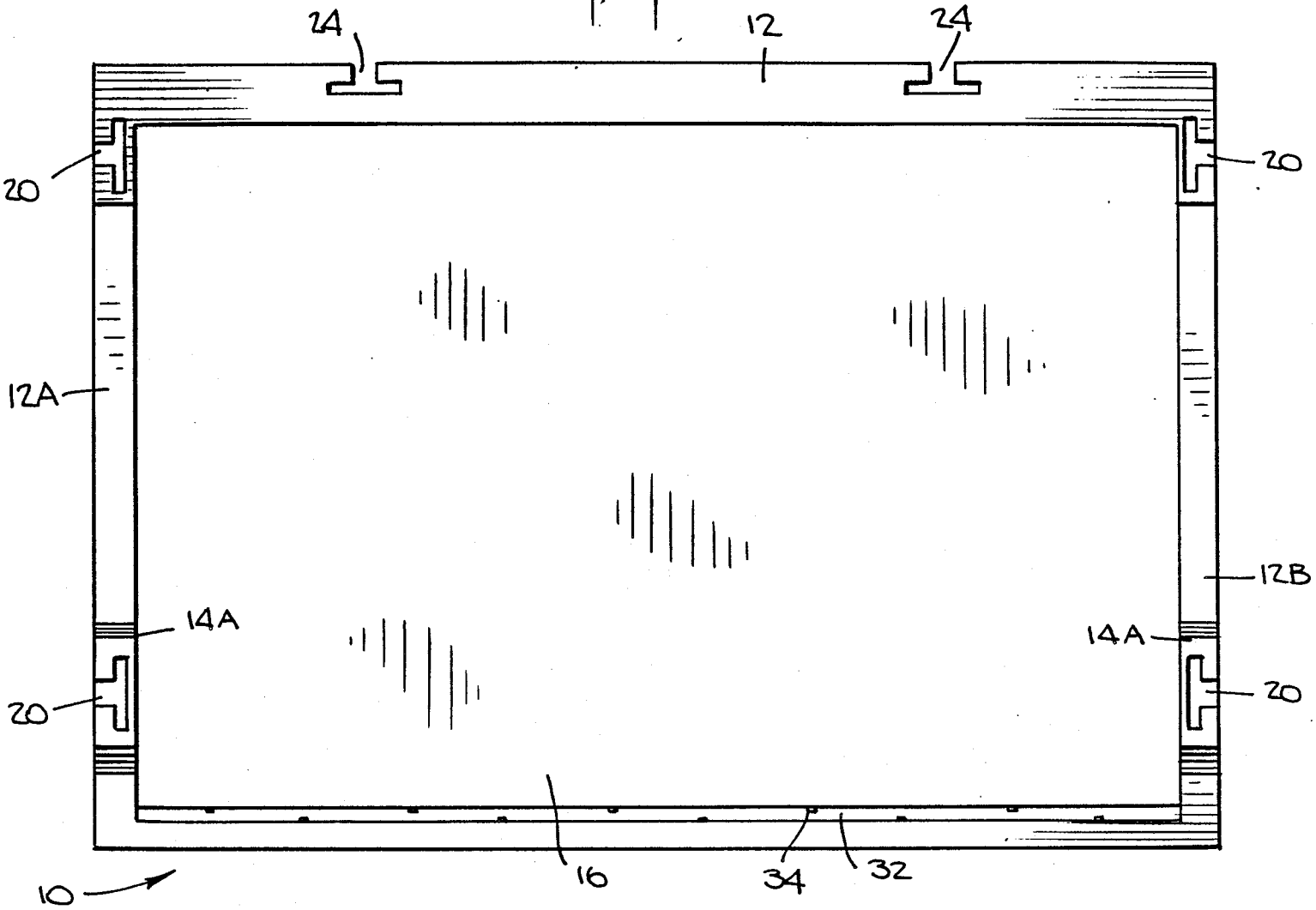
FIG. 6 shows a top view of the tray of FIG. 5.
Figure 7:
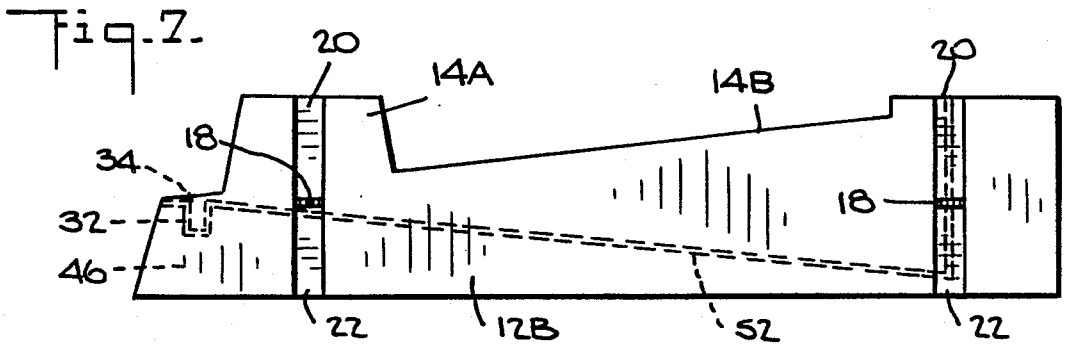
FIG. 7 snows an elevational view as viewed from the top side of FIG. 6.
Figure 8:
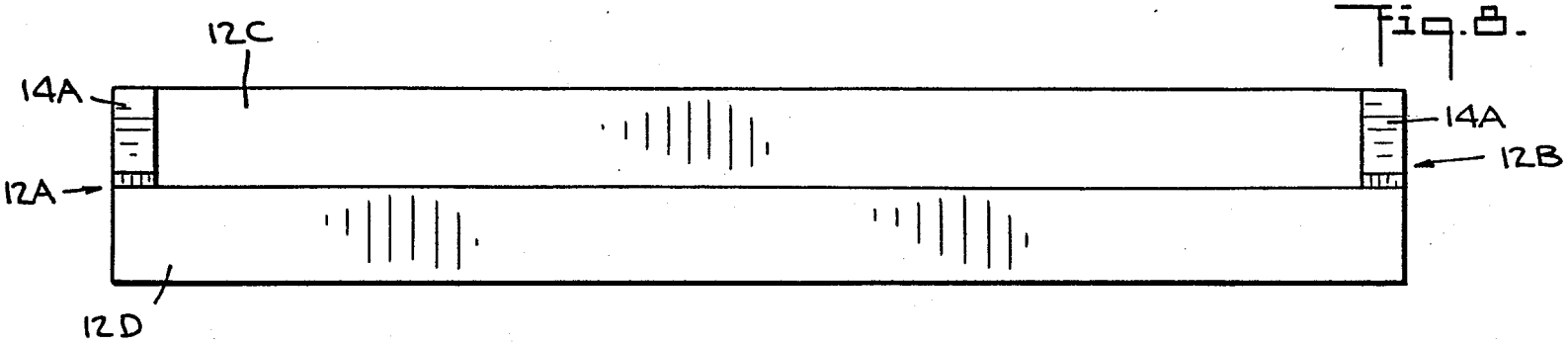
FIG. 8 shows an elevational view as viewed from the right side of FIG. 6.
Figure 9:
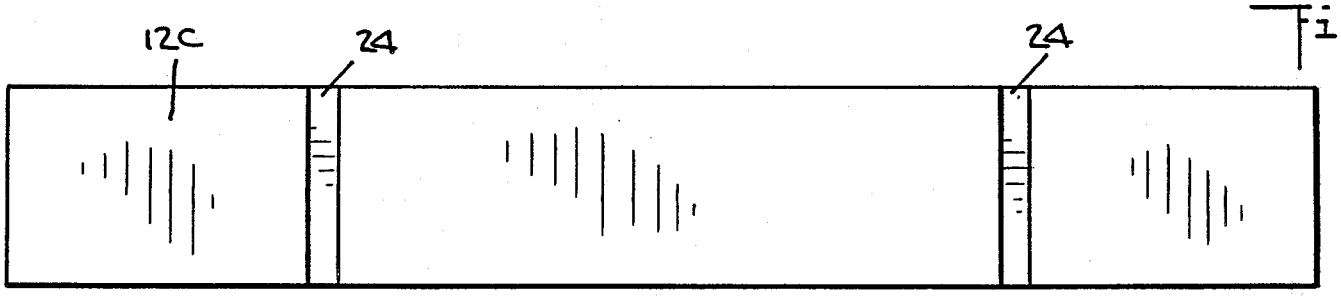
FIG. 9 shows an elevational view as viewed from the left side of FIG. 6.

It has been found to be advantageous to strengthen the T-shaped grooves 20, 22 by extending a supporting wall 40 (see FIG. 5) beneath the underside 52 of the base and to similarly extend two parallel supporting walls 42 from either side of T-shaped grooves 24 to another support wall 44, all of which is beneath the underside 52 of the base. This provides additional strength to the T-shaped grooves to enable friction fitting of the H-shaped support posts even after repeated use. Further, a predetermined amount of space 46 can be provided between this another support wall and the inclined front 48 of the base 16 to accommodate storage of the H-shaped support posts therein when disassembled. The underside 50 of slot or groove 32 is also shown in FIG. 5.

FIGS. 6–9 show the tray 10 in greater detail for better clarity. It should be understood that the side-by-side interlocked trays need not be identical; as long as their adjacent sidewalls from each tray have a generally complimentary surface, the sidewalls will be flush against each other. For ease of assembly, it is preferable for the adjacent sidewalls to have vertical and generally flat outer surfaces.

Figure 10:
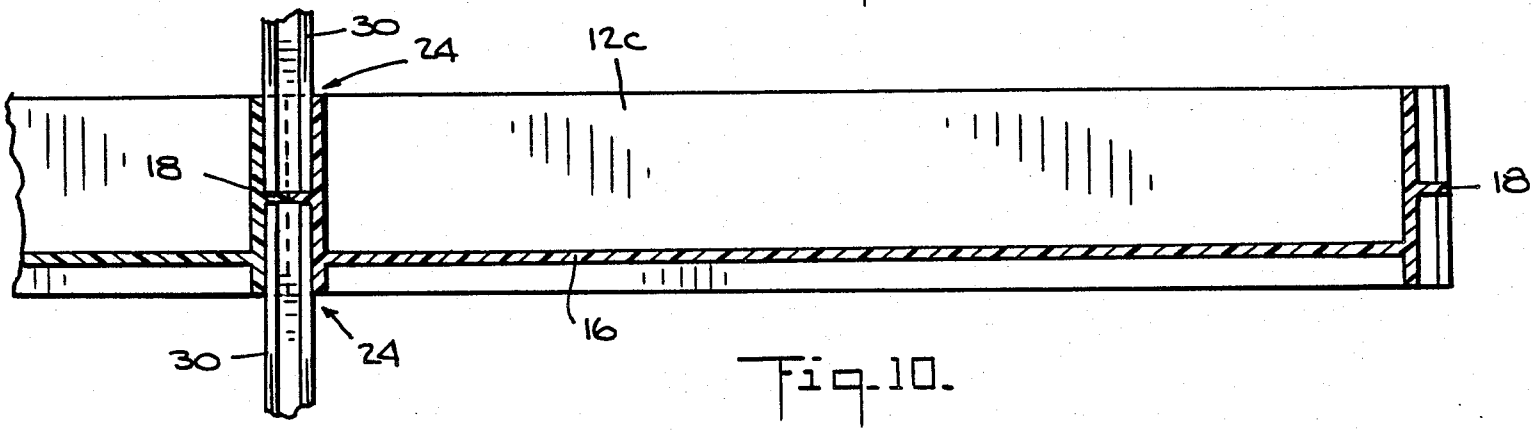
FIG. 10 shows a cross-section taken along section lines 10—10 of FIG. 4.

FIG. 10 is a cross-sectional view which better illustrates the interlocking feature. The support posts 30 can only be inserted into T-shaped slots as far as stopping walls 18 will allow.

While the foregoing description and drawings represent the preferred embodiments of the present invention, it will be understood that various changes and modifications may be made without departing from the spirit and scope of the present invention.

What is claimed is:

1. A stacking display, comprising:

a plurality of trays, each of said trays having a base with sidewalls extending perpendicular to said base from a periphery of said base, said sidewalls having generally flat outer faces so that a respective one of said outer faces can be positioned in substantially face-to-face contact with a complimentary outer face of another sidewall;

a plurality of elongated support posts each having an H-shaped cross-section;

interlocking means for interlocking said elongated support posts with said trays, said interlocking means including T-shaped slots within said sidewalls which are accessible from outside of said sidewalls, said support posts and said T-shaped slots being slidably engageable with each other so that pairs of adjacent T-shaped slots from adjacent trays together form an H-shape into which an end portion of a respective one of said support posts is insertable for locking together said adjacent trays, said respective one of said support posts having an opposite end portion for locking together another pair of said trays in the same manner and for locking both of said pairs of trays in a spaced relationship from each other; and means for stopping said support posts from inserting beyond a predetermined distance in at least one of said T-shaped grooves, said stopping means including a stopping wall dividing at least said one T-shaped groove.

2. A display as in claim 1, wherein said sidewalls of each of said trays include two sidewalls parallel to each other and another sidewall extending perpendicularly between said two sidewalls.

3. A display as in claim 2, further comprising: means for holding an advertising sign, said holding means including a groove extending in said base between said two sidewalls and extending parallel to said another sidewall.

4. A display as in claim 2, wherein said two sidewalls include a first portion having a trapezoidal shape cross-section, a second portion having a right triangular cross-section, and a third portion having a rectangular cross-section which is closer to said base than is said first and second portions.

5. A display as in claim 1, further comprising: means for strengthening said T-shaped grooves to maintain integrity of said T-shaped grooves over repeated insertion and removal of said support posts.

6. A display as in claim 1, wherein said strengthening means includes reinforcing walls extending under a top surface of the base and adjacent said T-shaped grooves, further comprising:

an area defining a space for accommodating two H-shaped support posts with an H-shaped cross-section underneath said base such that said two support posts do not protrude through a plane defined across bottom edges of said sidewalls.

7. A display as in claim 1, further comprising: at least two stacking display units arranged side-by-side each having pairs of trays with sidewalls which are adjacent to and flush against each other, said two stacking display units sharing at least one of said support posts which spaces apart said pairs of trays from each other, said two stacking display units each having a plurality of said support posts and said interlocking means.

8. A display as in claim 7, wherein said sidewalls which are adjacent to and flush against each other also have outer surfaces which are complimentary in shape to each other.

* * * * *